United States Patent [19]

Woolslayer et al.

[11] Patent Number: 4,598,509

[45] Date of Patent: Jul. 8, 1986

[54] METHOD AND APPARATUS FOR RAISING AND LOWERING A TELESCOPING MAST

[75] Inventors: Homer J. Woolslayer; Cecil Jenkins; Dewayne G. Vogt, all of Tulsa, Okla.

[73] Assignee: Lee C. Moore Corporation, Tulsa, Okla.

[21] Appl. No.: 747,926

[22] Filed: Jun. 24, 1985

[51] Int. Cl.[4] ..... E04H 12/18; E04H 12/10

[52] U.S. Cl. ..... 52/118; 52/115; 52/116; 52/119; 52/741

[58] Field of Search ..... 52/118, 119, 115, 116, 52/741; 212/184

[56] References Cited

U.S. PATENT DOCUMENTS

| | | | |
|---|---|---|---|
| 2,331,558 | 10/1943 | McEwen et al. | 189/14 |
| 2,354,922 | 8/1944 | McEwen et al. | 52/115 X |
| 2,762,471 | 9/1956 | Spencer | 189/14 |
| 2,804,948 | 9/1957 | Woolslayer et al. | 52/118 |
| 2,804,949 | 9/1957 | Woolslayer et al. | 189/11 |
| 2,829,741 | 4/1958 | Selberg et al. | 189/14 |
| 2,847,098 | 8/1958 | Heinish | 189/11 |
| 2,920,725 | 1/1960 | Emmons | 189/11 |
| 2,991,852 | 7/1961 | Lee | 189/14 |
| 3,233,375 | 2/1966 | Durand | 52/119 X |
| 3,388,810 | 6/1968 | Durand | 212/184 |
| 4,021,978 | 5/1977 | Busse et al. | 52/118 |
| 4,269,395 | 5/1981 | Newman et al. | 254/386 |

FOREIGN PATENT DOCUMENTS

| | | | |
|---|---|---|---|
| 1546575 | 10/1968 | France | 212/184 |

*Primary Examiner*—Alfred C. Perham

*Attorney, Agent, or Firm*—Laney, Dougherty, Hessin, Claro & Beavers

[57] ABSTRACT

Method and apparatus for raising and lowering a telescoping mast. A telescoping mast having an upper section slidably received within a lower section is pivotally connected to a base in a horizontal position. A line is connected to the lower end of the upper section and is placed over a pulley mounted on the upper end of the lower section and secured to the base. Upward pivoting of the lower section moves the mast to a vertical position while the upper section is extended by action of the line. Lowering the mast from the vertical position causes contraction of the upper section into the lower section.

9 Claims, 3 Drawing Figures

METHOD AND APPARATUS FOR RAISING AND LOWERING A TELESCOPING MAST

BACKGROUND AND SUMMARY OF THE INVENTION

The instant invention pertains to methods and apparatus for raising and lowering a telescoping mast and more particularly to such methods and apparatus which may be employed in a limited space, e.g., on an offshore platform.

In the drilling of an oil and gas well, a portable mast is usually used to support the drill string during drilling. After the well is completed, the mast is moved to a different location for drilling another well. To facilitate such portability, the mast is constructed to be divided into sub-assemblies during transporation. One such mast is of the telescoping variety which typically comprises an elongate lower section adapted to be mounted on a base surrounding a proposed wellbore and an elongate upper section which is slidably received, for example by a pulley system, within the lower section.

Many telescoping masts are constructed to be extended and contracted in a vertical position. That is, when the mast arrives at a location at which a well is to be drilled, the lower section, having the upper section received therein, is mounted on a base surrounding the proposed wellbore. Thereafter, rigging or hydraulic power is used to slide the upper section upwardly out of the lower section to its uppermost extended condition. When such condition is assumed, the upper section is mechanically spliced to the lower section to increase the rigidity of the mast.

Telescoping masts designed for erection in the vertical position as described above suffer from several disadvantages. One disadvantage is that in its extended condition, the axes of the elongate beams in the upper and lower mast sections are offset relative to one another which produces a less stable mast than if the beams are in coaxial alignment. U.S. Pat. No. 2,804,948 to Woolslayer et al. discloses a telescopting portable mast which includes an upper section that is slidably received substantially within a lower section. In its extended condition, the elongate beams in the upper and lower sections, which form the primary support for the mast in its vertical position, are in coaxial alignment with one another. The Woolslayer et al. '948 patent teaches extension of the mast in a horizontal position since the elongate support beams in the upper section must move laterally with respect to the elongate support beams in the lower section to produce coaxial alignment in the extended condition. Extension of the mast in a horizontal position is not possible when space is limited, for example on an offshore drilling platform.

It is a general object of the present invention to provide a method and apparatus for raising and lowering a telescoping mast.

It is a more specific object of the invention to provide such a method and apparatus in which the mast is not extended or contracted in a vertical or horizontal position.

It is another specific object of the invention to provide such a method and apparatus which requires less space than that required to extend the mast in a horizontal position.

It is yet another specific object of the invention to provide such a method and apparatus which pivots the mast to a vertical position during mast extension and pivots the mast to a horizontal position during mast contraction.

It is still another object of the invention to provide such a method and apparatus which utilizes the same power source to pivot and extend the mast.

These and other objects and advantages of the instant invention will be more clearly understood as the following detailed description is read in view of the accompanying drawings wherein.

DETAILED DESCRIPTION OF A PREFERRED EMBODIMENT OF THE INVENTION

Figure 1:
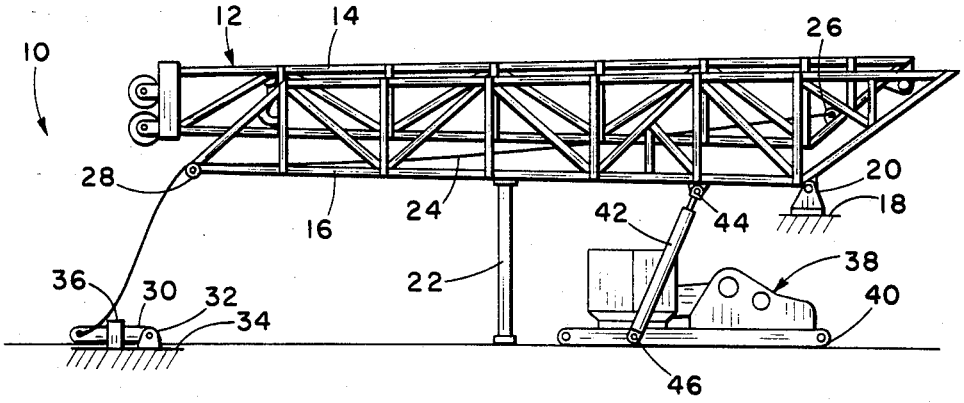
FIG. 1 is a side elevational view of a telescoping mast in a contracted horizontal position.

Indicated generally at 10 in FIG. 1 is equipment constructed in accordance with the apparatus of the instant invention for raising and lowering a drilling mast 12. Drilling mast 12 is of the type described in U.S. Pat. No. 2,804,948 to Woolslayer et al. and includes an upper section 14 and a lower section 16. Upper section 14 is slidably received substantially within lower section 16 and may be axially extended from the lower section via a series of rollers (not visible) in the manner described in the Woolslayer et al. '948 patent. It is to be appreciated that the method and apparatus of the invention may be employed with any suitable telescoping mast of the type having an upper section slidably received substantially within a lower section.

Lower section 16 is pivotally attached to a base 18 via pivotal connection 20. The mast is supported in its horizontal position by conventional mast stand 22. A line 24 has one end fixedly attached to an eye 26 mounted on the lower end of section 14. The line is received over a pulley 28 mounted on the upper end of lower section 16. The other end of line 24 is fixedly attached to one end of a link 30 which has its other end pivotally attached via a pivotal connection 32 to a base 34. Bases 18, 34, although not at the same level, are fixed relative to the ground and to each other. A clamp 36 is removably mounted on base 34 over link 30 thus securing the link in the position shown in FIG. 1. Although not shown in the drawings for the sake of clarity, a second line, like line 24, may be connected to the other side of the mast and to base 34 in the same fashion as line 24. When a second line is so connected a second pulley, like pulley 28, and a second link, like link 30, are operatively connected to the second line as pulley 28 and link 30 connect to line 24.

A conventional drawworks 38 is mounted on a sled 40. When mast 12 is erected, drawworks 38 is used to raise and lower the drill string in the bore in the usual fashion. An hydraulic ram 42 is pivotally connected at one end to lower mast section 16 via pivotal connection 44 and is pivotally connected at its other end to sled 40 via connection 46. A second ram (obscured by ram 42) is pivotally connected to the other side of lower mast section 16 and to sled 40 in the same fashion as ram 42. Each ram includes a two-stage cylinder with the second stage being double acting.

In operation, drilling mast 12 and the associated equipment are placed in the configuration of FIG. 1.

Figure 2:
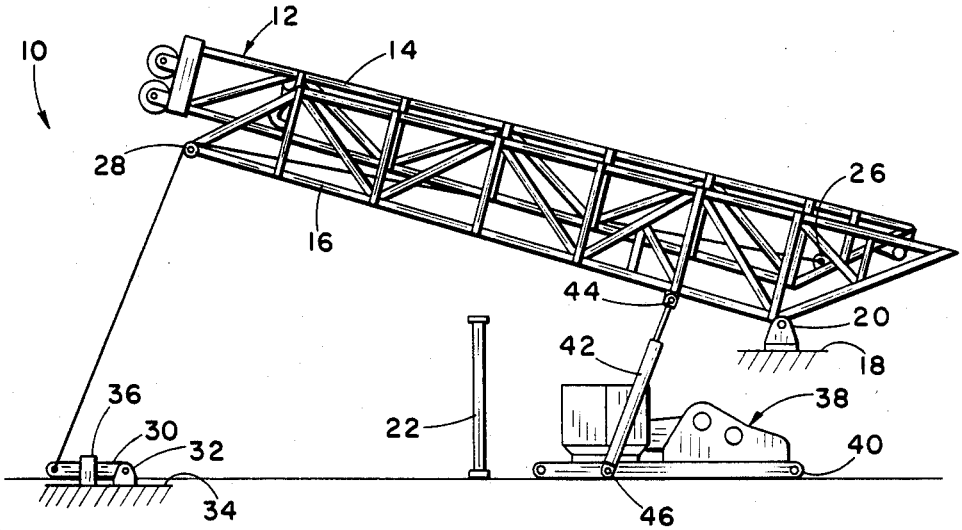
FIG. 2 is a side elevational view of the mast of FIG. 1 at an angle of approximately fifteen degrees.

Thereafter, hydraulic fluid is provided to the rams, one of which is ram 42, to cause ram extension and thus upward pivoting of the mast as shown in FIG. 2. When the mast assumes the position of FIG. 2, line 24 becomes taut and continued upward pivoting from the position of FIG. 2 causes upper section 14 to begin extending out of the lower mast section due to the action of line 24 on the lower end of section 14.

Figure 3:
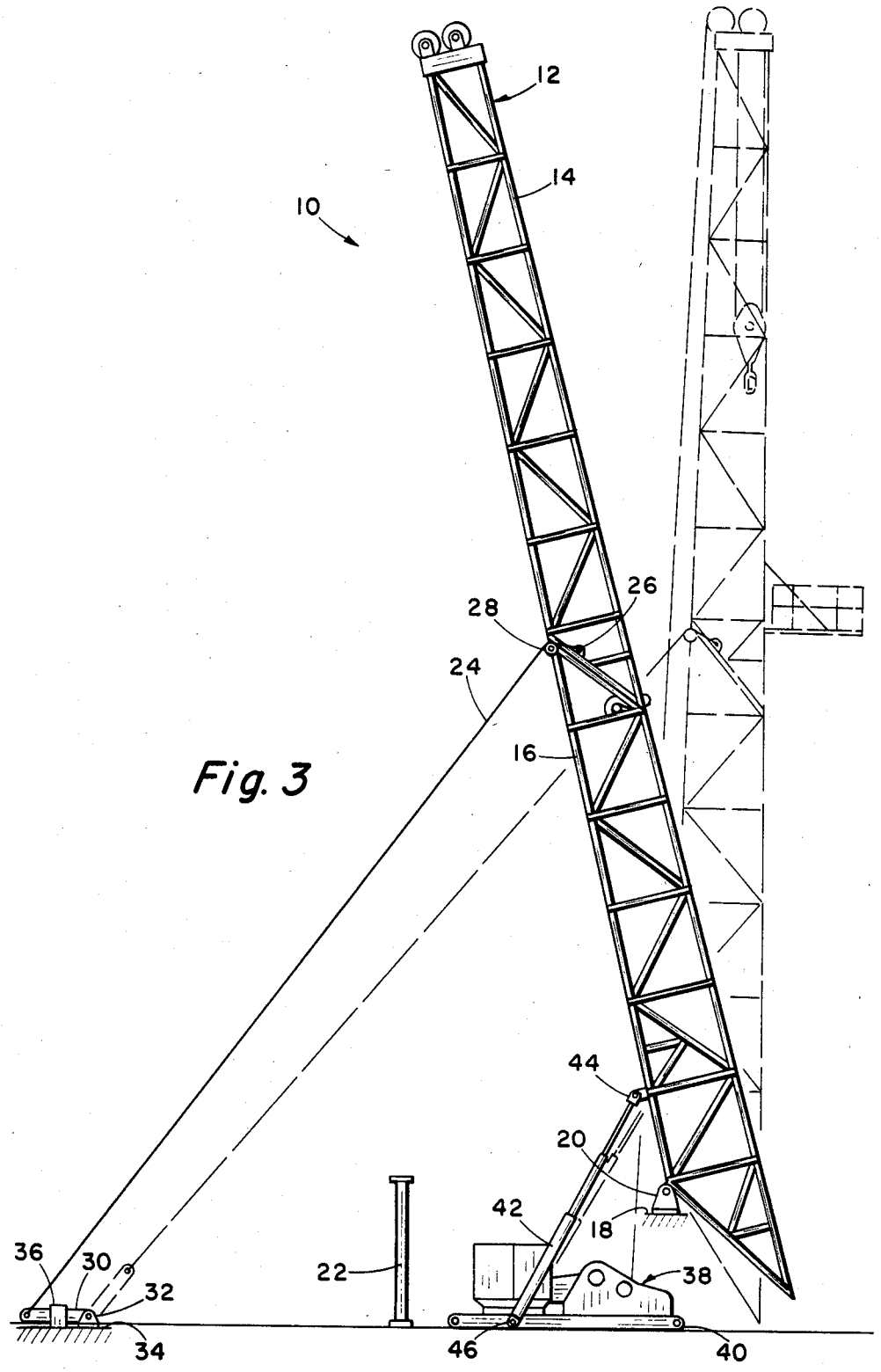
FIG. 3 is a side elevational view of the mast in its extended condition at an angle of approximately b 85 degrees and a dashed-line view of the extended mast in a vertical position.

Continued upward pivoting ultimately brings mast 12 to its fully extended condition as shown in solid lines in FIG. 3. When the solid-line position of FIG. 3 is obtained, upper section 16 and lower section 14 are spliced together, as described in the Woolslayer et al. '948 patent, to increase the stability of the fully extended mast. After splicing, clamp 36 is removed from base 34 thus enabling line 30 to pivot about pivotal connection 32. Thereafter, the rams, like ram 42, are extended until mast 12, line 24, and link 30 assume the dashed-line position of FIG. 3. In this position, lower section 16 is pinned to base 18 with pins (not shown) and the mast is ready for use. Line 24 may be disconnected from eye 26 and link 30 during drilling.

After drilling is completed and the mast is no longer needed at the well, line 24 is tied to eye 26 and is run over pulley 28 to link 30 so that the mast, line and link are in the dashed-line position of FIG. 3. Thereafter, lower mast section 16 is unpinned from base 18 to enable pivotal movement about connection 20. Then the rams, like ram 42, are contracted to pivot mast 12 downwardly to the solid-line position of FIG. 3. When such is reached, link 30 is secured in its solid-line position via clamp 36 and the splices locking the upper section to the lower section are removed. Continued lowering from the solid-line position of FIG. 3 causes upper section 14 to begin contracting into the lower section. Such lowering continues until the upper section is fully received within the lower section which occurs at the position of FIG. 2. Continued contraction of the rams brings the mast to its horizontal position resting on mast stand 22 in FIG. 1.

It is to be appreciated that additions and modifications may be made to the embodiment of the invention disclosed herein without departing from the spirit of the invention which is defined in the following claims.

What is claimed is:

1. Apparatus for raising and lowering a telescoping mast of the type having a lower section which is pivotally attached to a base and an upper section which is slidably received substantially within the lower section, said apparatus comprising:

a pulley mounted on the upper end of said lower section;

a line for placing over said pulley;

means for attaching one end of said line to the lower end of said upper section;

means for attaching the other end of said line to said base, said attaching means comprising:

a link including means for pivotally attaching one end thereof to said base;

means for attaching the other end of said line to the other end of said link; and means for securing said link in a nonpivotal condition.

2. Apparatus for raising and lowering a telescoping mast of the type having a lower section which is pivotally attached to a base and an upper section which is slidably received substantially within the lower section, said apparatus comprising:

a pulley mounted on the upper end of said lower section;

a line having one end attached to the lower end of said upper section and the other end attached to said base, said line being placed over said pulley;

means for pivoting said mast to a substantially vertical position, said upper section being pulled out of said lower section by said line during mast pivoting;

means for disconnecting the other end of said line from said base to permit said mast to be pivoted into a substantially vertical position after said line becomes taunt, said disconnecting means comprising:

a link having one end pivotally mounted on said base, the other end of said line being attached to the other end of said link; and means for securing said link in a nonpivotal condition.

3. A method for lowering a telescoping mast of the type having a lower section which is pivotally attached to a base and an upper section which is mechanically spliced to the lower section and which is slidable into the lower section upon release of the splices, said method comprising the steps of:

mounting a pulley on the upper end of the lower section;

securing one end of a line to the lower end of the upper section;

placing said line over said pulley:

pivoting the mast downwardly from a substantially vertical position;

stopping said downward pivoting;

securing the other end of said line to said base so that said line is taut;

releasing said mechanical splices; and thereafter pivoting the mast downwardly, said upper section being lowered by said line into said lower section.

4. The method of claim 3 wherein the step of pivoting the mast downwardly from a substantially vertical position comprises the step of pivoting the mast to an attitude of substantially fifteen degrees from vertical.

5. The method of claim 3 wherein said line is of a length sufficient to permit said upper section to be completely contracted prior to said mast being pivoted to a horizontal position and wherein said method further includes the step of pivoting the mast to a substantially horizontal position after said upper section is completely contracted.

6. The method of claim 5 wherein said mast is fully contracted at an attitude of substantially fifteen degrees from horizontal.

7. A method for erecting a telescoping mast of the type having a lower section which is pivotally attached to a base and upper section which is slidably received substantially within the lower section, said method comprising the steps of:

mounting a pully on the upper end of the lower section;

securing one end of a line to the lower end of the upper section;

placing said line over said pulley;

securing the other end of said line to said base, said line having a preselected amount of slack therein;

pivoting the mast upwardly from a substantially horizontal position, said upper section being extended after said line becomes taut;

stopping said upward pivoting when said upper section is fully extended, said line being of a length to prevent further upward pivoting when said upper section is fully extended;

mechanically splicing said upper section to said lower section;

releasing the tension in said line; and thereafter pivoting the mast upwardly to a substantially vertical position.

8. The method of claim 7 wherein the step of pivoting the mast upwardly from a substantially horizontal position comprises the step of pivoting the mast to an attitude of substantially fifteen degrees from horizontal.

9. The method of claim 7 wherein said mast is fully extended at an attitude of substantially fifteen degrees from vertical.

* * * * *